United States Patent [19]

Kühn

[11] Patent Number: 4,785,651

[45] Date of Patent: Nov. 22, 1988

[54] DEVICE FOR AXIAL DISPLACEMENT OF ROLLS IN A ROLLING STAND

[75] Inventor: Helmut Kühn, Siegen, Fed. Rep. of Germany

[73] Assignee: SMS Schloemann-Siemag AG, Düsseldorf, Fed. Rep. of Germany

[21] Appl. No.: 828,069

[22] Filed: Feb. 10, 1986

[30] Foreign Application Priority Data

Feb. 8, 1985 [DE] Fed. Rep. of Germany ..... 3504415
Jun. 13, 1985 [DE] Fed. Rep. of Germany ..... 3521180

[51] Int. Cl.[4] ..... B21B 31/18

[52] U.S. Cl. ..... 72/247; 72/21; 72/35; 72/238; 72/249

[58] Field of Search ..... 72/247, 243, 241, 238, 72/20, 21, 249, 32, 35

[56] References Cited

U.S. PATENT DOCUMENTS 3,973,425 8/1976 Woodrow ..... 72/247
4,369,646 1/1983 Kajiwara ..... 72/247 X
4,491,005 1/1985 Kimura et al. ..... 72/247 X
4,499,748 2/1985 Nihei et al. ..... 72/247 X

FOREIGN PATENT DOCUMENTS 0087911 5/1984 Japan ..... 72/247

*Primary Examiner*—Robert L. Spruill
*Assistant Examiner*—Steven B. Katz
*Attorney, Agent, or Firm*—Toren, McGeady & Associates

[57] ABSTRACT

A device for axial displacement for a roll in a rolling stand. The roll is mounted in a chock which is guided in a roll housing. The chock is adjustably guided in the rolling stand. The roll is axially displaced by a hydraulic piston-cylinder assemblies acting on the rolling stand and connected to the support member of the roll bearing. The roll bearing is axially slidingly guided in the chock. The chock has a guide for a sliding carriage which is provided with a coupling device for the roll neck. The hydraulic piston-cylinder assemblies are articulated to this sliding carriage.

6 Claims, 11 Drawing Sheets

V
111
112
113
114
116
117
118
119
120
122
123
124
125
126
129
130
136
138
152
157
159
160
161
162
163
164
165
166
167
168
169
170
171
172
173
A
B
C

DEVICE FOR AXIAL DISPLACEMENT OF ROLLS IN A ROLLING STAND

BACKGROUND OF THE INVENTION

1. Field of the Invention

The present invention relates to a device for the axial displacement of rolls in a rolling stand, wherein the rolls are mounted in chocks which are guided adjustably sliding in roll housings of the rolling stand and wherein the rolls are axially displaced by hydraulic piston-cylinder assemblies which are braced against the rolling stand and are connected to the support member of the roll bearing.

2. Description of the Prior Art

A known device of this type disclosed in German Patent No. 2,440,495 intended for a roll stand with two working rolls, two intermediate rolls and two backup rolls, includes two axially outwardly protruding arms on the chock of each intermediate roll, wherein each of these arms is engaged through a connecting member by a piston-cylinder assembly. The two piston-cylinder assemblies are fastened in the housings of the roll stands laterally of the respective chock either directly to the housing or to support blocks releasably connected to the housing.

The prior art device has the disadvantage that the axial displacement forces to be transmitted from the piston-cylinder assembly to the roll chock in accordance with the position of adjustment of the roll and of the chock cannot be transmitted centrally onto the center axis of the roll, because the projecting arms of the chock are usually spaced either above or below the common axis plane of the piston-cylinder assembly and the force may be transmitted through the connecting member while simultaneously generating a corresponding bending moment.

In addition, the device mentioned above has a great structural weight because the complete radial and axial bearings are arranged in the chock individually and in combination and the entire chock has to be axially displaced during the axial displacement of the rolls. Depending upon the type of rolling stand used, the displacement is very difficult because the chocks must be guided in the direction of adjustment, i.e., transversely of the direction of displacement. Additional difficulties occur in the case of driven rolls because the coupling sleeve required for the drive transmission cannot be easily accommodated on the roll neck between the two projecting arms of the chock. Therefore, the drive in rolling stands equipped with this type of device is as a rule effected from the other side of the roll.

Therefore, it is the primary object of the present invention to provide a device for the axial displacement of rolls in a rolling stand which avoids the disadvantages and difficulties described above.

SUMMARY OF THE INVENTION

In accordance with the present invention, the device for the axial displacement of a roll in a rolling stand includes bearings of the roll which are axially displaceable within the chock and a sliding carriage which can be coupled to the roll neck, wherein a sliding guide for the carriage is provided on the chock and the hydraulic piston-cylinder assemblies are articulated to the carriage.

In the device according to the invention, the sliding carriage including the appropriate coupling device moves together with the chock at all times and follows the adjusting movements of the chock, so that the center axis of the coupling device is aligned with the center axis of the roll independently of the position of adjustment of the roll.

In accordance with another feature of the invention, the coupling device may be mounted in the sliding carriage by means of a deep-groove-type radial ball bearing whose axially acting component acts as an axial bearing for the roll, so that the axially displaceable roll bearing mounted in the chock can be designed essentially as a radial bearing. As a result, the roll neck carrying the bearing and the chock can be dimensioned shorter and narrower, and the heat dissipation from the heavily loaded axial bearing is simplified. This arrangement also makes possible the use of roll necks having shorter lengths.

The hydraulic piston-cylinder assemblies which may on the one side be articulated to the sliding carriage, may on the other side be articulated to the chock or the support members of the guides of the sliding carriage and the support of the sliding carriage may be a pair of cantilever arms on the chock which extend outwardly from the roll and parallel to the roll axis, wherein the sliding carriage is guided coaxially with the roll between the cantilever arms. It is possible to support a coupling sleeve for the roll drive spindles connected with the coupling device externally of the area of the cantilever arms in the sliding carriage, so that the head of the drive spindle for the roll can be introduced into the coupling sleeve without interference from the cantilever arms. Therefore, a roll stand equipped with the device according to the invention can be driven from the side on which the device according to the invention is mounted.

In accordance with another feature of the present invention, the support housing of the deep-groove-type radial ball bearing arranged in the sliding carriage is mounted so as to be elastically yielding transversely of the bearing axis, so that any bending occurring during the operation of the rolls is absorbed and the resulting center displacement in the area of the axial bearing component is compensated. In the device constructed in this manner, the movement generated by the axial displacement drive is directly transmitted to the neck of the roll through the separate axial bearing which is located outside of the chock in the sliding carriage. After coupling with the roll neck, a permanently positively locking connection is effected which simultaneously is continuously centered on the center axis of the roll.

In a prior embodiment, a coupling device includes a coupling sleeve rotatably and non-displaceably supported in a sliding carriage, wherein the coupling sleeve has coupling retainers for a neck portion of the roll which retainers slide in conically converging guide grooves, the other ends of the retainers being connectable to a push and pull element which can be displaced and fixed in the direction of the center axis of the roll, and wherein the coupling sleeve proper is supported in a deep-groove-type radial ball bearing arranged to be axially non-displaceable in the sliding carriage. This embodiment leads to difficulties under certain conditions because the deep-groove-type radial ball bearing is located outside of the roll neck and, therefore, radially directed pressure components generated by the roll can reach and be absorbed by the bearing only through the coupling sleeve over a relatively long axial distance. In addition, the structural component located between the deep-groove-type radial ball bearing and the roll neck which transmits these pressure components must be dimensioned accordingly. Moreover, it is difficult to determine this dimension because the coupling sleeve including the guide grooves for the coupling retainers constitutes a structural element whose cross-sectional size changes in axial direction and, therefore, is difficult to calculate with respect to the transmission of compressive forces.

In accordance with the present invention, these difficulties can be avoided and a structurally simple device can be provided, wherein a small number of elements and particularly a small number of rotating elements are used and wherein the exchange of structural parts for maintenance is simplified, if the deep-groove-type radial ball bearing receives the roll neck and if the coupling device is arranged on that end face of the neck bushing of the deep-groove-type radial ball bearing which faces away from the roll neck, wherein the coupling device includes a support piece which is connected to the neck bushing and has coupling links insertable in an annular groove of the roll neck and a sliding sleeve which is axially slidable over the support piece and effects a radial displacement or pivoting of the coupling links. The sliding sleeve is advantageously acted upon against the pressure of a spring by means of piston-cylinder assemblies non-rotatably mounted in the sliding carriage. The piston-cylinder assembly may be actuated through a control device by means of a position-indicating element which is displaceably mounted in the support piece so as to be acted upon by the roll neck and is biased by the pressure of a spring. The position-indicating element is composed, for example, of a cylindrical pin centrally mounted in the support piece, wherein an end face of the pin faces an end face of the roll neck.

In accordance with yet another feature of the present invention, the coupling links may include drive blocks having central recesses which blocks are displaceable in radial guide grooves of the support piece. The central recesses are engaged by the first ends of double levers supported in the support piece, wherein the second ends of the levers rest against inner guideways of the sliding sleeve. The drive blocks are acted upon by inner clamping guides of the sliding sleeve which extend conically narrowing toward the inside within the sleeve. The side of the sliding sleeve facing away from the roll neck may be slidingly guided on a center cylinder portion of the support piece and have a cylindrical projection which surrounds the cylinder portion, wherein a shifting fork connected to the piston-cylinder assembly is slidingly guided on the cylindrical projection and may be brought into contact with limiting collars of the cylindrical projection.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
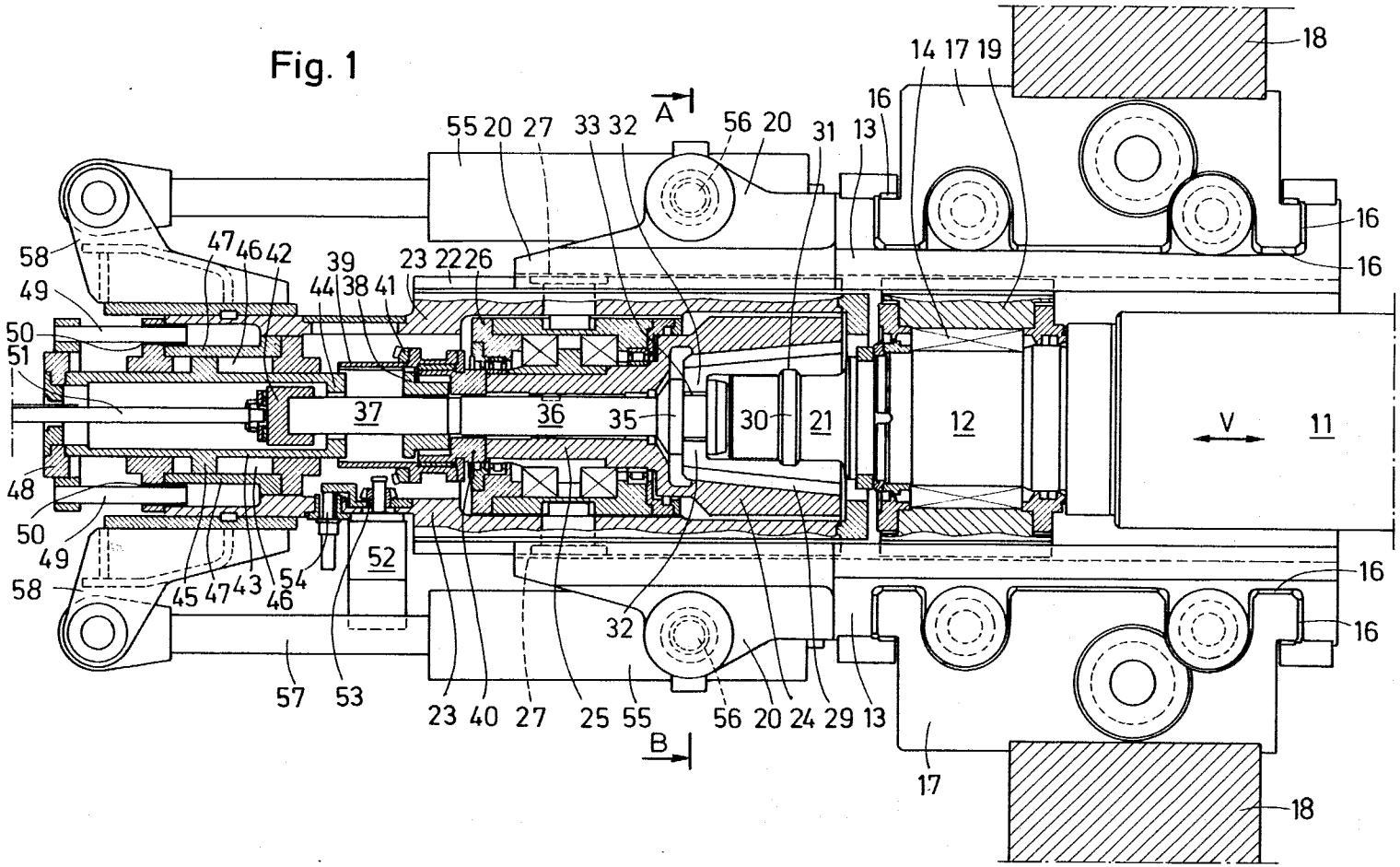
FIG. 1 is a sectional view of a first embodiment of the device according to the invention in axial direction of the device.
Figure 2:
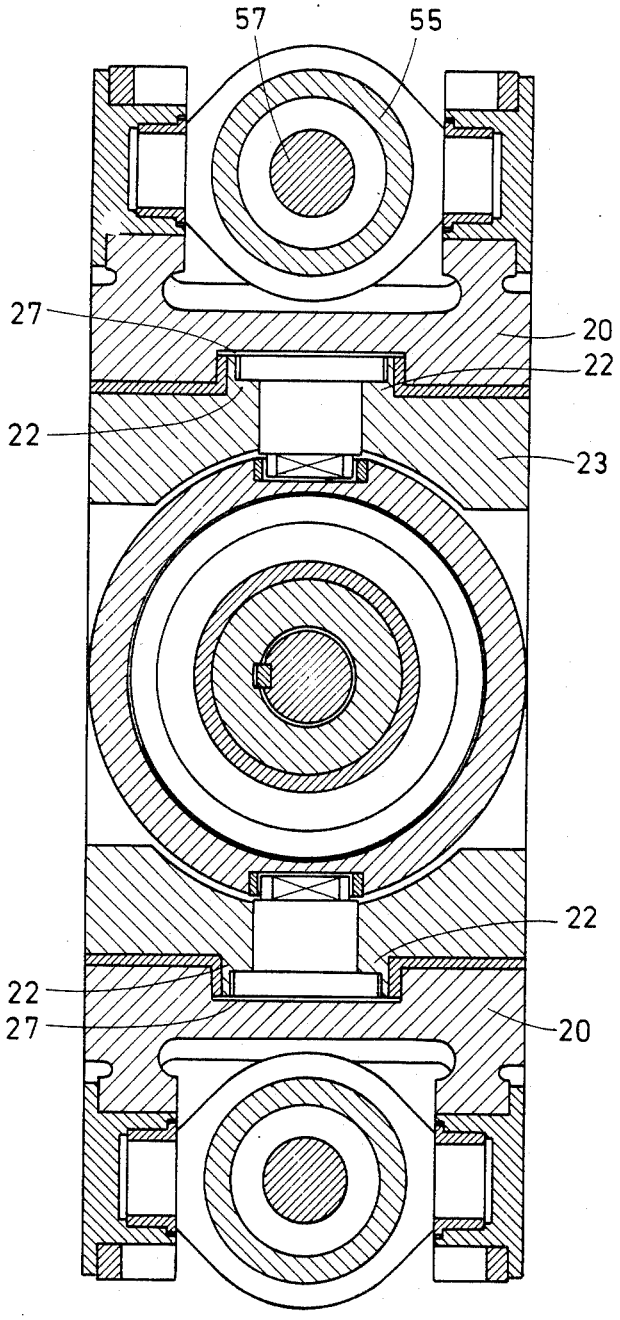
FIG. 2 is a sectional view along line A-B of FIG. 1, on an enlarged scale.
Figure 3:
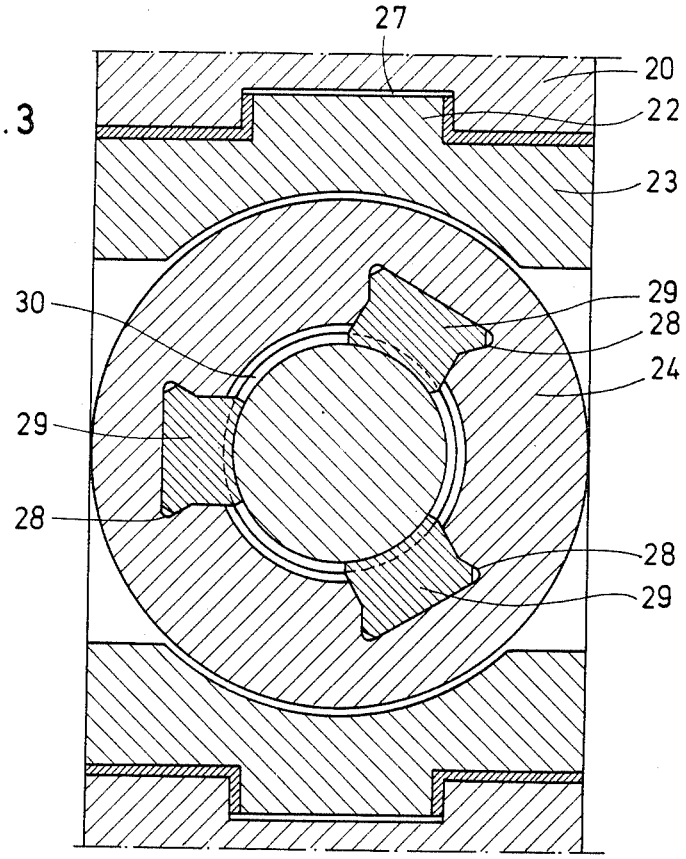
FIG. 3 is a sectional view along line C-D of FIG. 1, on an enlarged scale.

As illustrated in FIG. 1, the device according to the invention includes a first neck portion 12 of a roll 11 with a bearing 14 arranged on a chock 13. Chock 13 is adjustably guided on sliding faces 16 of an intermediate part inserted in a roll housing 18. Bearing 14 for neck portion 12 of roll 11 is seated on a support piece 19 which is guided to be axially displaceable in chock 13. Chock 13 has cantilever arms 20 on the side facing away from roll 11. Arms 20 extend on both sides of a further end neck portion 21 of roll 11. FIGS. 2 and 3 show a sliding carriage 23 guided with projecting ledges 22 in longitudinal grooves 27 of cantilever arms 20 extending parallel to the axis of roll 11. A coupling sleeve 24 is supported with an axially extending cylindrical projection 25 in sliding carriage 23. A bearing 26 for cylindrical projection 25 of coupling sleeve 24, inserted non-rotatably into sliding carriage 23, is designed as a deep-groove-type radial ball bearing.

Figure 4:
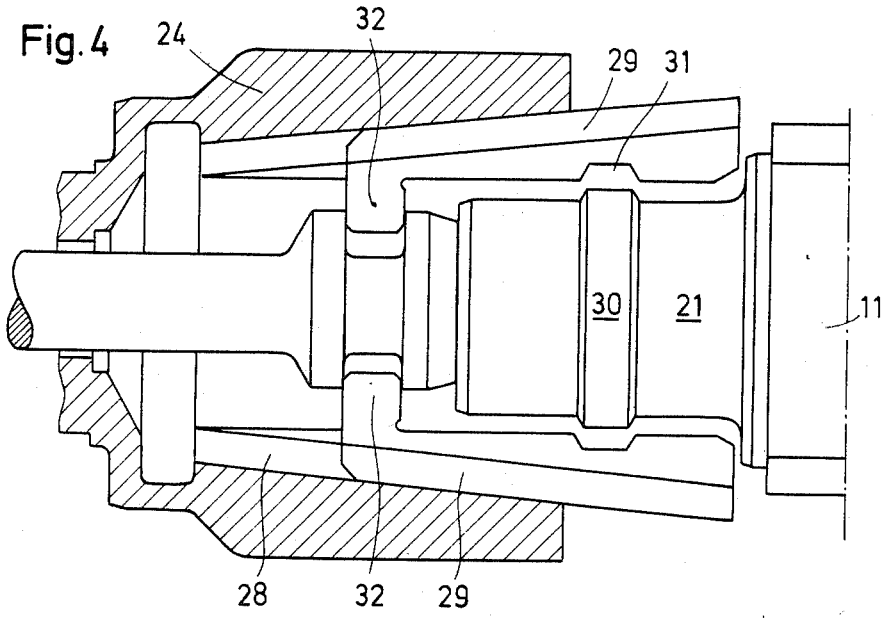
FIG. 4 shows, on an enlarged scale, a detail from FIG. 1 in another operating position.
Figure 5:
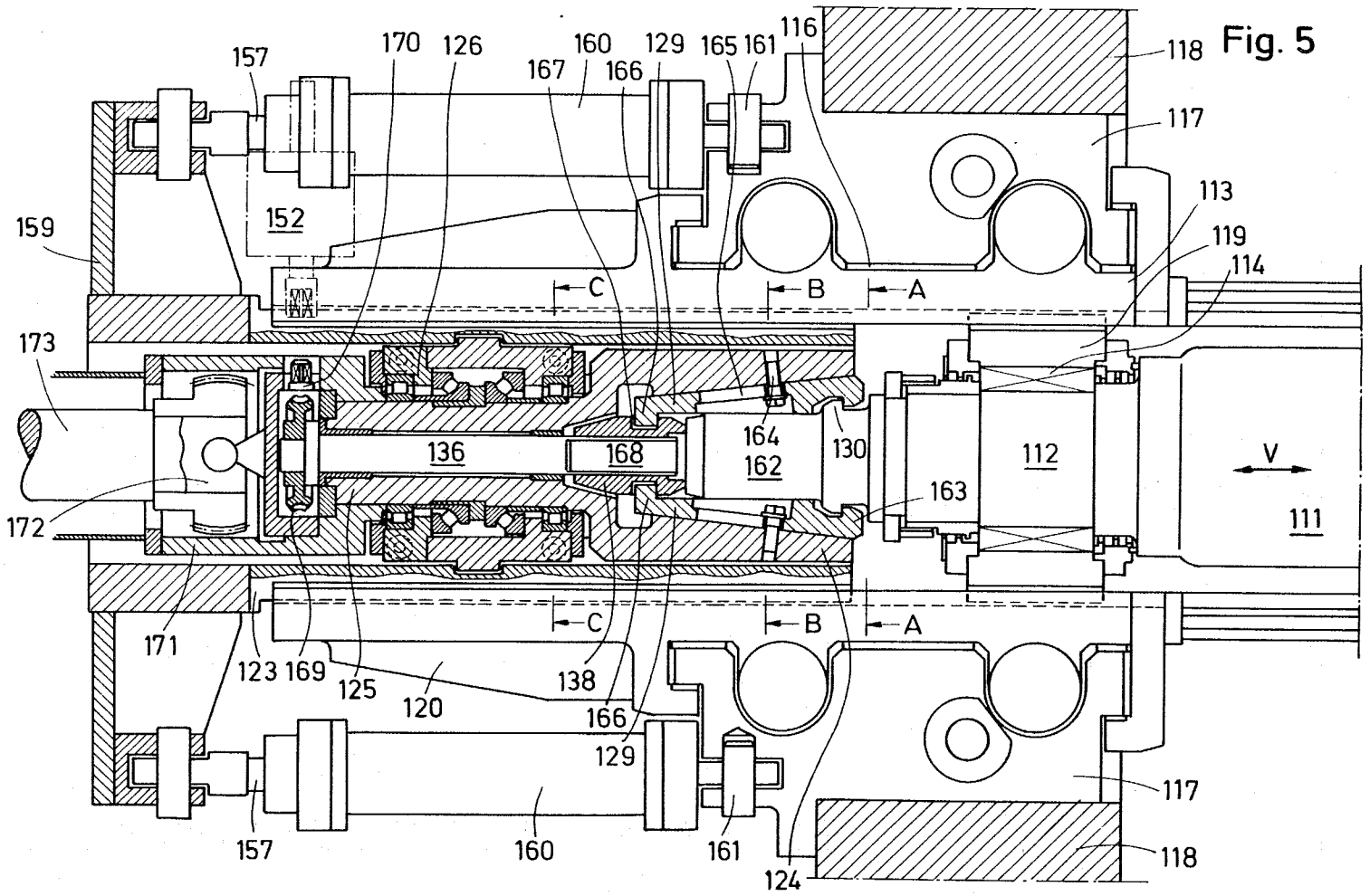
FIG. 5 is a sectional view of a second embodiment of the device according to the invention in axial direction.
Figure 6:
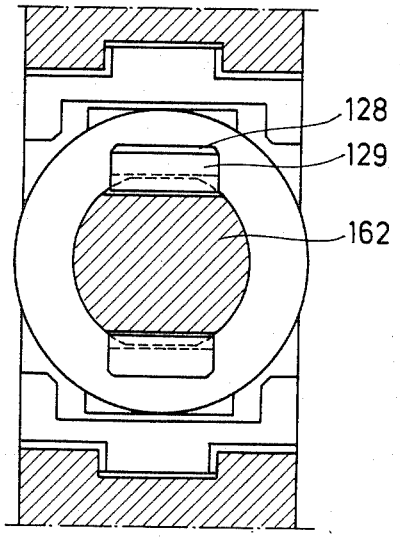
FIG. 6 is a sectional view along line A-A of FIG. 5, on an enlarged scale.
Figure 7:
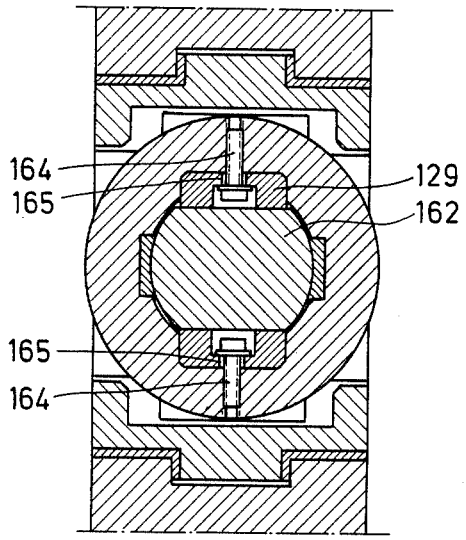
FIG. 7 is a sectional view along line B-B of FIG. 5, on an enlarged scale.

As can be seen in FIGS. 3 and 4, coupling sleeve 34 has guide grooves 28 for coupling hooks 29 which extend inclined toward each other. Hooks 29 have hook ends 32 and indentations 31 placed on an annular collar 30 of neck portion 21. Indentations 31 and hook ends 32 are insertable into an annular groove 33 of a head piece 35 of a tie rod 36.

Tie rod 36 is arranged to be non-rotatably and axially displaceable in cylindrical projection 25 of coupling sleeve 24. The end 37 facing away from head piece 35 is provided with a thread onto which a nut 38 is screwed. Nut 38 is seated in a cylindrical sleeve 39 so as to be axially displaceable. Cylindrical sleeve 39 is supported rotatably and axially immovably on an annular projection 40 connected with cylindrical projection 25 and is embraced by an annular gear 41. A drive cap or ring 42 is screwed onto threaded free end 37 of tie rod 36 and is encircled by a hollow cylinder 43 which has at its end facing nut 38 a circular collar 44 directed inwards and at its outer wall an annular piston collar 45 directed outwards. Collar 45 is movable in an annular cylinder 46 and can be acted upon by a pressure medium in a manner not shown, wherein cylinder 46 is formed between hollow cylinder 43 and a cylinder 47. Hollow cylinder 43 carries at its other outwardly directed end a cross head 48 which is guided by means of axially oriented guide rods 49 in sliding guides 50 at the external side of cylinder 47.

A contact rod 51 is supported at the front face of drive ring 42 facing away from end 37 of tie rod 36. The other end of rod 51 is supported in cross head 48 to be non-rotatable and displaceable. A motor 52 with sliding pinion 53 is arranged at sliding carriage 23. Pinion 53 can be brought into and out of meshed engagement with annular gear 41 of cylindrical sleeve 39 by means of an actuating link 54.

Cylinders 55 of a pair of piston cylinder assemblies are articulated in pivot bearings 56 at cantilever arms 20 whose piston rods 57 are supported in bearing brackets 58 which are attached at the sides of sliding carriage 23.

The device operates as follows. In the working position depicted in FIG. 1, end neck portion 21 of roll 11 is connected positively to coupling sleeve 24 through annular collar 30 and hook ends 32 engaging in annular groove 33 of head piece 35 of tie rod 36 and the coupling hooks 29 wedged with coupling sleeve 24. Tie rod 36 is fixed axially by means of annular projection 40 against the bearing 26 by tightened nut 38 on the thread of the end of tie rod 36. Bearing 26, in turn, as already described, is seated in sliding carriage 23 to be axially non-displaceable. Roll 11 can be displaced by the desired amount axially in direction of arrows V of FIG. 1 by actuation of the piston rods 57, since piston rods 57 actuate sliding carriage 23 by means of bearing brackets 58.

The connection between coupling sleeve 24 and roll 11 is detached by rotating cylinder sleeve 39 and nut 38 by actuation of motor 52 over sliding pinion 53 and annular gear 41, so that nut 38 moves in direction of annular collar 44 of hollow cylinder 43. When nut 38 has reached the desired axial distance from its contact face at annular projection 40, hollow cylinder 43 is moved in direction of nut 38 by actuation of annular piston collar 45 on the side facing away from nut 38 until the outer annular face of annular collar 44 rests at the front face of nut 38. Subsequently, the hollow cylinder 43 pushes the nut 38 and with it tie rod 36 in direction onto the roll 11 with the consequence that head piece 35 of tie rod 36 pushes the coupling hooks 29 in the guide grooves 28 of coupling sleeve 24 out of the coupling sleeve and into the position depicted in FIG. 4, wherein the indentations 31 detach themselves from annular collar 30 of end neck portion 21. In the course of this movement, roll 11 is displaced in direction of the push of the tie rod 36, without moving at the same time the sliding carriage 23. After the coupling connection between coupling sleeve 24 and end neck portion 21 has been released in this manner, roll 11 can be removed from the other side of the roll stand in direction facing away from the device and can be replaced by another roll 11.

The placement of the coupling sleeve 24 onto the end neck portion 21 of the newly installed roll 11 is effected in reverse order. Coupling sleeve 24 is moved into position with respect to the end neck portion 21 of new roll 11 depicted in FIG. 4 with the help of a displacement of sliding carriage 23 by actuation of piston rods 57. Subsequently, by acting on annular piston collar 45 of hollow cylinder 43 on the side facing nut 38, hollow cylinder 43 is displaced away from nut 38, and the inner annular face of annular collar 44 comes to rest against the opposite annular face of drive ring 42. Thus, tie rod 36 together with nut 38 are moved in direction away from end neck portion 21, with the consequence that hook ends 32 engaging into annular groove 33 of head piece 35 of tie rod 36 pull the coupling hooks into the coupling sleeve until these assume the already described coupling position according to FIG. 1.

As soon as this coupling is produced, nut 38 is made to rotate with the help of motor 52 by means of cylinder sleeve 39 until its face facing end neck portion 21 comes to rest at the opposite annular end of annular projection 40, so that the already described locking state depicted in FIG. 1 with bearing 26 and sliding carriage 23 is produced. The hollow cylinder 43 subsequently is moved into the original position depicted in FIG. 1 and the device is now ready for the displacement of the roll 11. The respective position of operation of roll 11 within the device, i.e. the achievement of coupling or decoupling positions, is shown by the position of contact rod 51 which can be connected in a known manner to display and monitoring devices.

In the embodiment of the device according to the invention shown in FIGS. 5–9, a driven roll 111 is connected with the device. Roll 111 is arranged, as in the embodiment according to FIGS. 1–4, with a bearing 114 seated on a neck portion 112 to be axially displaceable in the chock 113 by means of a support piece 119. Chock 113 can be adjustably displaced on sliding faces 116 of intermediate piece 117 seated in roll housing 118. A sliding carriage 123 is slidingly guided in cantilever arms 120 of chock 113. The displacement of carriage 123 is caused by piston rods 157 of cylinders 160 articulated at a cross head 159. Cylinders 160 are linked by means of articulated bearings 161 to intermediate piece 117, which is different from the embodiment according to FIGS. 1–4. The end neck portion 162 of roll 111 designed as a neck with flat surfaces, has an annular collar 130 which is gripped from the rear by hook ends 163 of coupling hooks 129. Hooks 129 slide in guide grooves 128 of coupling sleeve 124 and are retained by screws 164 which engage in slots 165. With their other ends 166, coupling hooks 129 engage into annular groove 167 of a nut 138 which is screwed onto threaded end 168 of the tie rod 136, which, in turn, is rotatably supported in cylindrical projection 125 of coupling sleeve 124.

Cylindrical projection 125 is, as in the embodiment according to FIGS. 1–4, rotatably and axially non-displaceably arranged in sliding carriage 123 by means of a bearing 126 designed as a deep-groove-type radial ball bearing. On the free end of tie rod 136 is seated a worm wheel 169 which meshes with screw 170 movable in and out of the driving position radially with respect to the rotational axis of worm wheel 169 by means of motor 152 indicated by dash-dotted lines. A coupling sleeve 171 with internal toothing is attached to cylindrical projection 125 engaged by a gear head 172 of a drive spindle 173.

Figure 8:
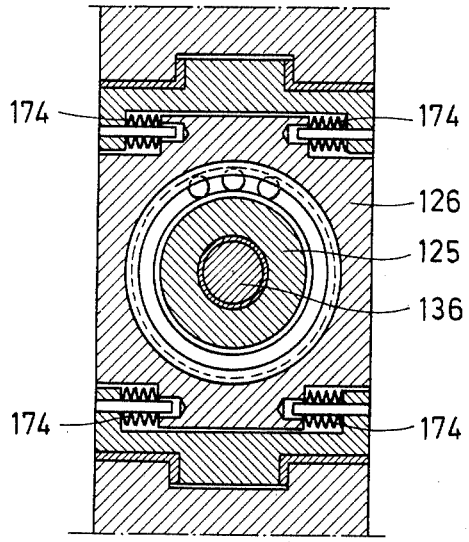
FIG. 8 is a sectional view along line C-C of FIG. 5, on an enlarged scale.

As can be seen from FIG. 8, bearing 126 is elastically supported against radial shock loads with the help of spring packs 174.

The device operates as follows. In the locked position of end neck portion 162 illustrated in the drawing, roll 111 can be axially displaced in the direction of arrows V through actuation of piston rods 157 of cylinder 160 over cross head 159, sliding carriage 123, bearing 126, tie rod 136, nut 138 and coupling sleeve 124 with coupling hooks 129. Roll 111 is driven by the drive spindle 173 over toothed head 172, coupling sleeve 171, cylindrical projection 125, coupling sleeve 124, coupling hooks 129 acting on end neck portion 162 of roll 111 having flat surfaces.

Figure 9:
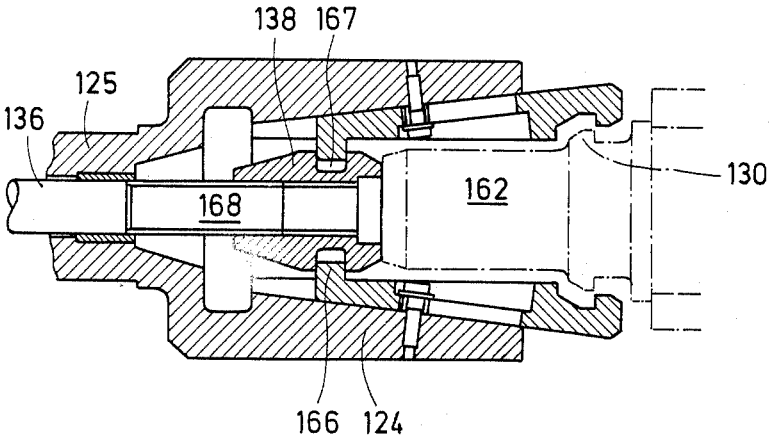
FIG. 9 shows, on an enlarged scale, a detail from FIG. 5 in another operating position.

The coupling between roll 111 and coupling sleeve 124 is detached by rotating tie rod 136 through motor 152, and screw 170 and worm wheel 169, wherein nut 138 moves toward roll 111, and with its annular end face which rests against the end face of end neck portion 162 moves roll 111 out of coupling sleeve 124 into the position depicted in FIG. 9, so that hook ends 163 are detached from annular collar 130 of end neck portion 162. Roll 111 can, as already described, be removed on the operating side of the roll stand 118 and be replaced by another roll. As in the embodiment according to FIGS. 1 to 4, sliding carriage 123 is brought into the position with respect to end neck portion 162 of roll 111 depicted in FIG. 9 with the help of cylinders 160 and piston rods 157 and then, by driving tie rod 136 in the reverse rotational sense by motor 152, nut 138 is moved in the contrary sense to the described opening movement, so that coupling hooks 129 are pulled into coupling sleeve 124 by means of hook ends 166 seated in annular groove 167. The other hook ends 163 grasp annular collar 130 of end neck portion 162 and bring it into the coupled position with coupling sleeve 124 depicted in FIG. 5.

Figure 10:
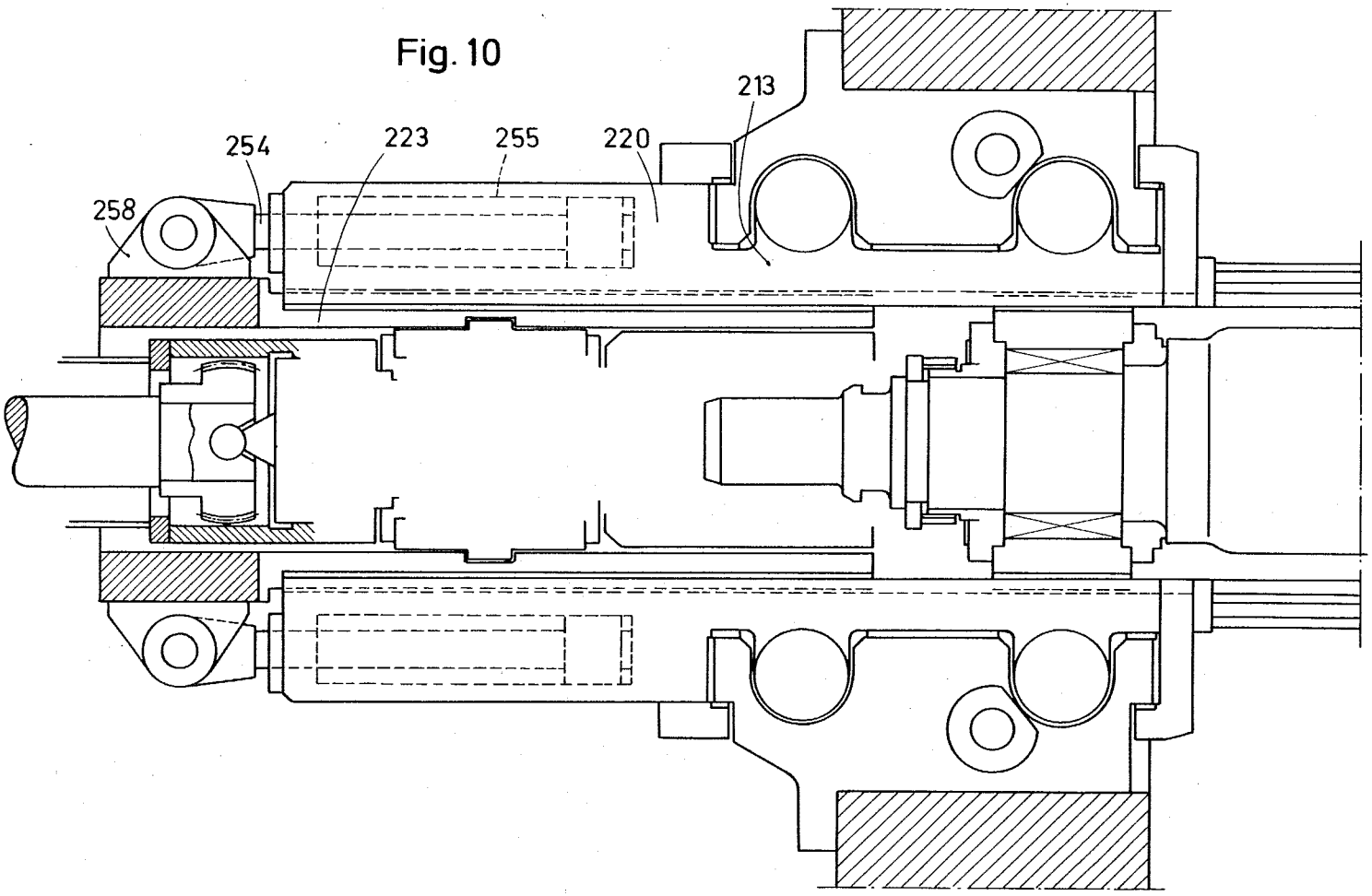
FIG. 10 is a sectional view of a third embodiment of the device according to the invention in axial direction.

The embodiment according to FIG. 10 differs from the one previously described according to FIGS. 5–9 only in that cylinders 255, as in the embodiment according to FIGS. 1–4, are arranged in cantilever arms 220 of chock 213 and are articulated with piston rod 254 at bearing bracket 258 of sliding carriage 223, so that they are moved as an entire unit together with chock 213 and sliding carriage 223 in adjustment direction during the adjustment movement, i.e., different from the embodiment according to FIGS. 5–9, in which cylinders 160 with the piston rod 157 execute a compensating pivoting movement in a plane parallel to the adjustment plane of the center axis of roll 111.

Figure 11:
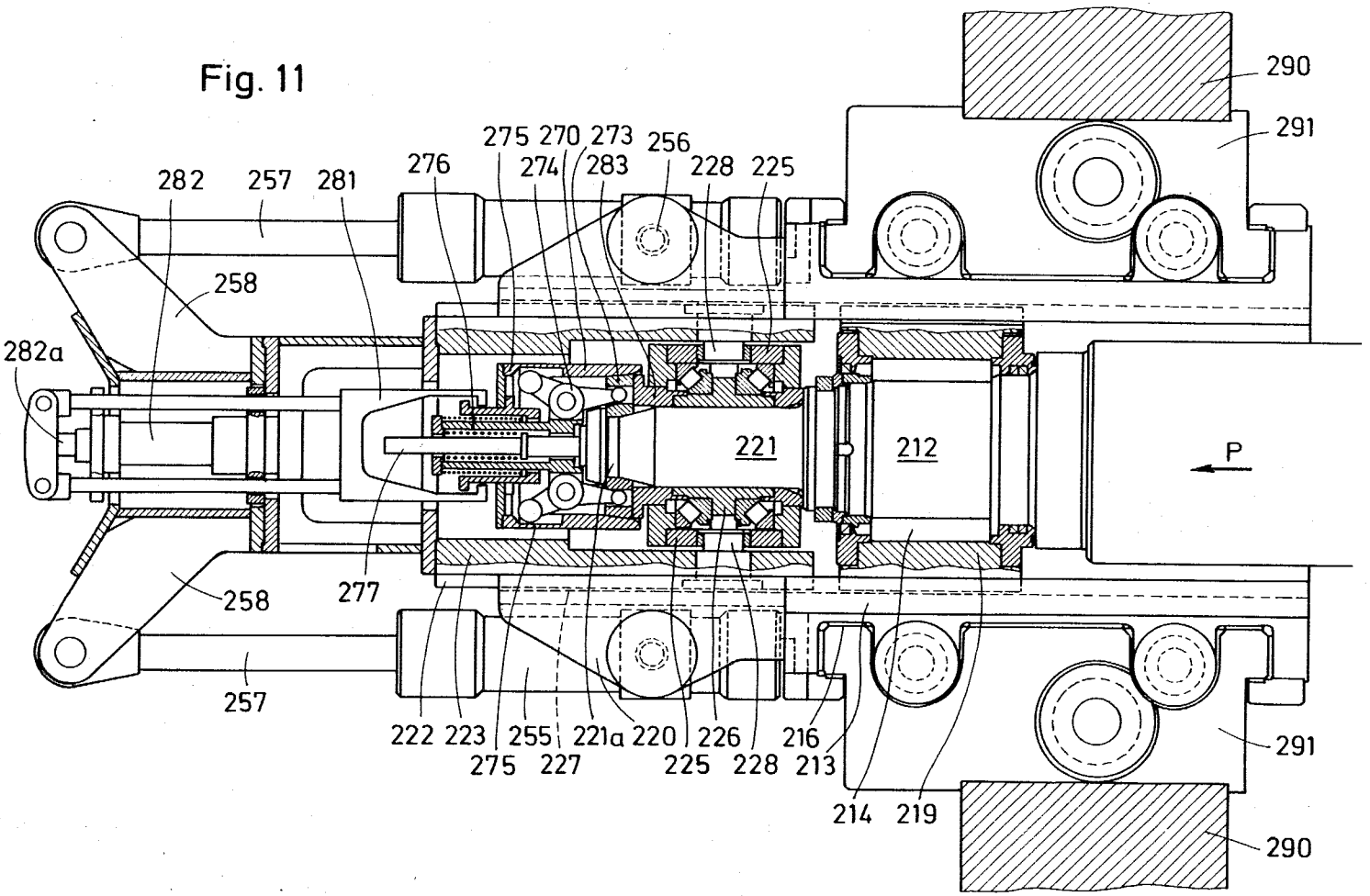
FIG. 11 is a sectional view of the device in coupled position with the roll journal shown axially offset along line C-D of FIG. 12.
Figure 12:
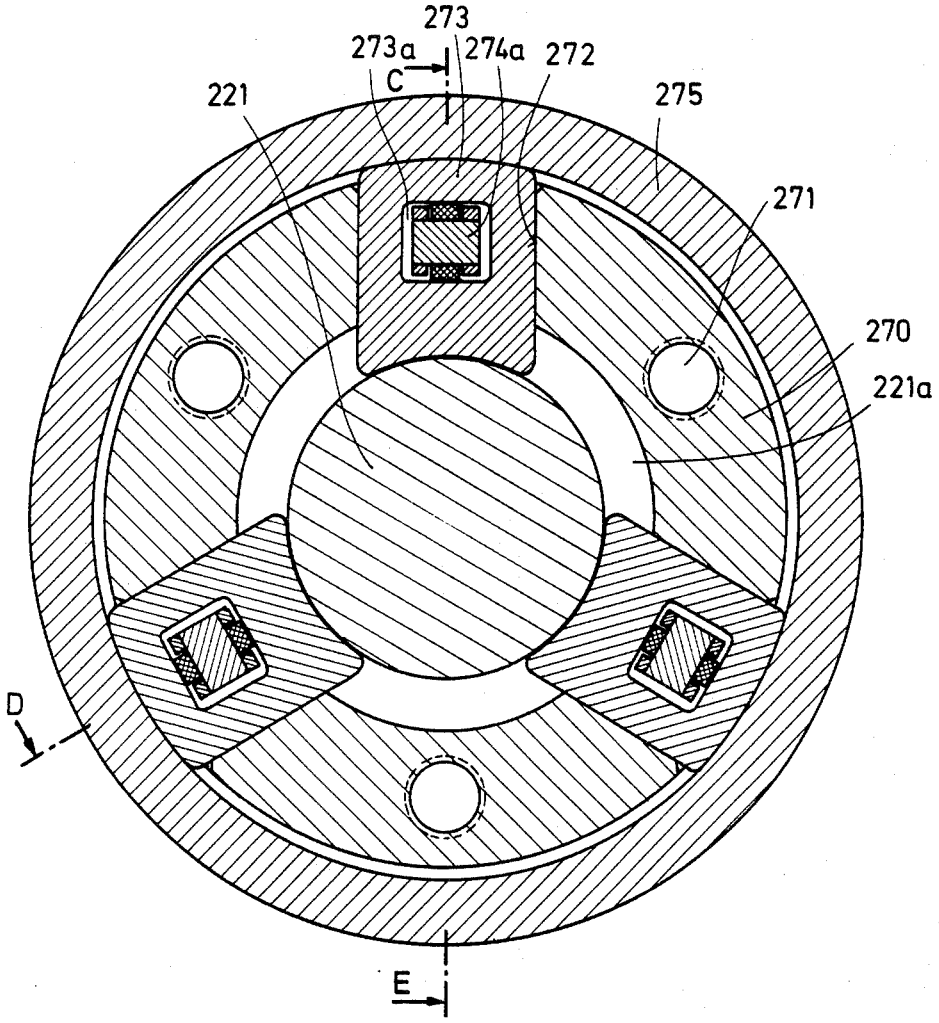
FIG. 12 is a sectional view along line A-B of FIG. 13 on an enlarged scale.
Figure 13:
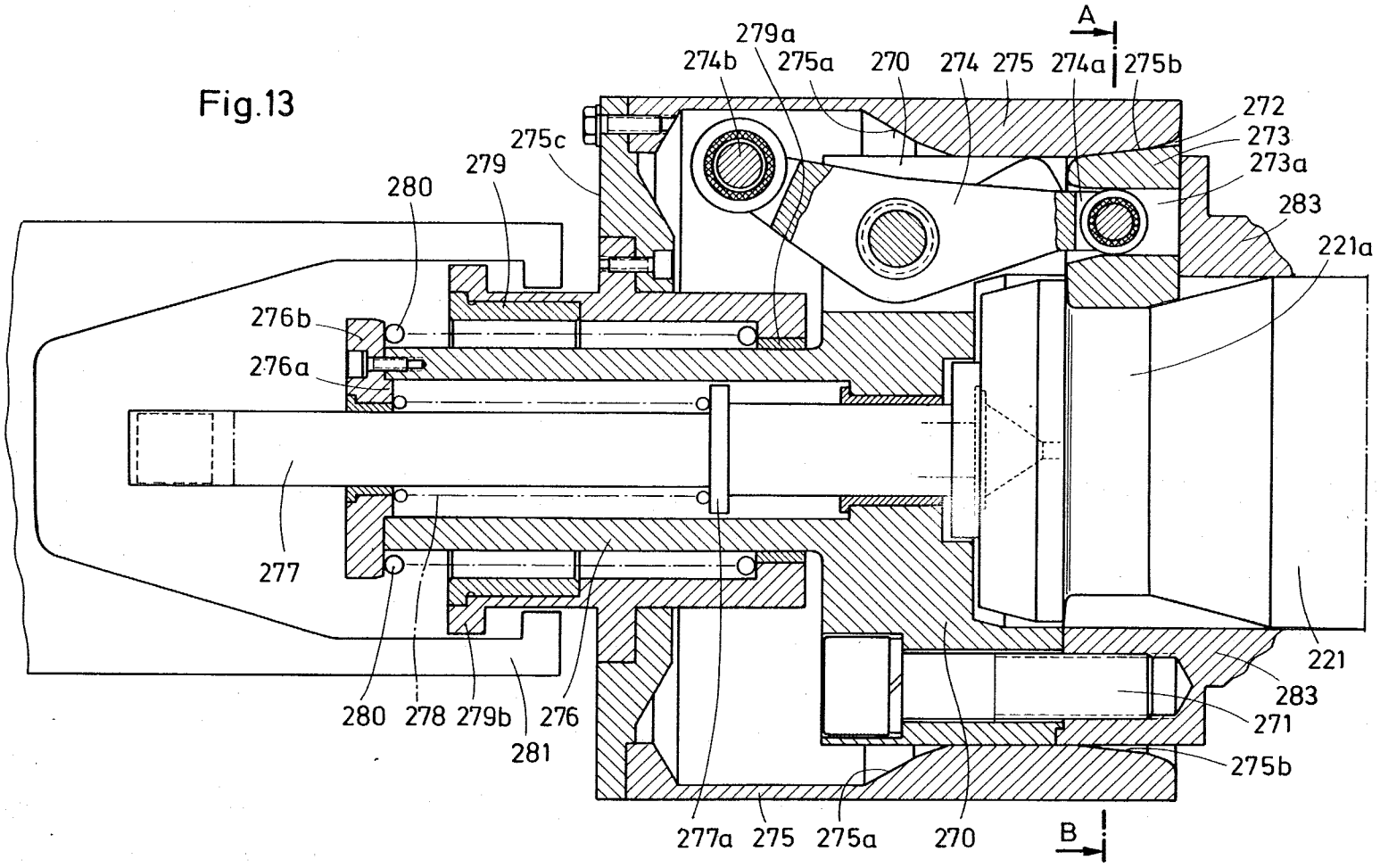
FIG. 13 is a partial sectional view along line C-E of FIG. 12 on an enlarged scale.

As can be seen from FIGS. 11–13, a first neck portion 212 with bearing 214 is arranged in chock 213 which is adjustably guided on sliding faces 216 of an intermediate piece 291 inserted into roll housing 290. Bearing 214 of the roll neck portion 212 is seated in a carrier piece 219 which is guided in chock 213 to be axially displaceable. The chock 213 has cantilever arms 220 on the side facing away from roll neck projection 212 which arms extend on both sides of an additional end neck portion 221. A sliding carriage 223 is guided with projecting ledges 222 in longitudinal grooves 227 of cantilever arms 220 extending parallel to the roll axis. In sliding carriage 223, a deep-groove-type radial ball bearing 225, 226 is arranged and fixed to be axially undisplaceable by means of a retaining bolt 228. At the end face of neck bushing 226 of the deep-groove-type radial ball bearing 225, 226 facing away from roll neck portion 221, see also FIGS. 12 and 13, a support ring 283 is arranged and is solidly connected with the deep-groove-type radial ball bearing. Support ring 283 has a radial guide troughs 272 in which drive blocks 273 are axially displaceable. The drive blocks 273 are insertable into an annular groove **221*a* of roll neck portion 221 and have central recesses 273*a* into which engage ends 274*a* of double levers 274 which are supported in a support piece 270 connected by means of screws 271 with support ring 283. The other ends 274*b* of the double levers rest on inner guideways 275*a* of the sliding sleeve 275**.

Sliding sleeve 275 furthermore has inner clamping guides **275*b* which narrow inwardly and rest against drive blocks 273. Furthermore, a central cylindrical projection 276 is arranged at the side of support piece 270 facing away from the roll neck portion 221 in which a cylindrical pin 277 acting on a position signal element is supported to be longitudinally displaceable. This cylindrical pin 277 is pressed by a spring 278 which abuts against an inner annular collar 276*a* of cylindrical projection 276 and on annular collar 277*a* of the cylindrical pin, with its front side in direction to the front side of the roll neck portion 221. The sliding sleeve 275 has at the side facing away from the roll neck portion 221 a cylindrical projection 279 which concentrically embraces cylindrical projection 276 of support piece 270 and glides thereon with an inner annular collar 279*a*. A spring 280 abuts against an outer annular collar 276*b* of the cylindrical projection 276 of support piece 270 which presses sliding sleeve 275 in direction of the roll neck portion 221**.

In addition, an outer annular collar **279*b* is provided at the annular end of the cylindrical projection 279 facing away from roll neck portion 221, between which collar 279*b* and end face 275*c* of sliding sleeve 275 a switching fork 281 engages. Fork 281 is connected with a piston rod 282*a* of a piston cylinder assembly 282 which is arranged in sliding carriage 223. Cylinders 255 of a pair of piston-cylinder assemblies in pivot bearings 256 are articulated at the cantilever arms 221 guiding the sliding carriage 223. Piston rods 257 of the piston-cylinder assemblies are supported in bearing brackets 258 which are attached on the end of sliding carriage 223**.

Figure 14:
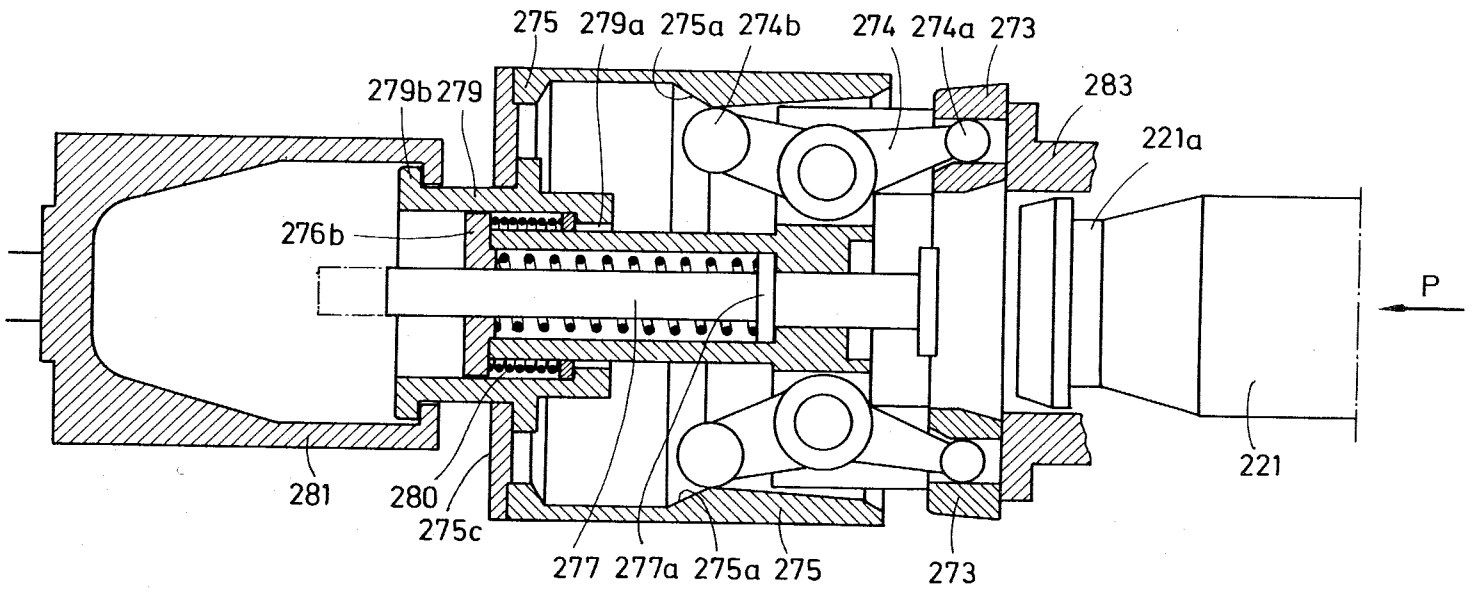
FIG. 14 shows, on an enlarged scale, a detail of the device according to FIG. 11 in a decoupled position.

The device works as follows. In the position depicted in FIG. 14, the piston cylinder assembly 282 with switching fork 281 has pulled sliding sleeve 275 into an external position away from roll neck portion 221 against the action of spring 280. Cylindrical pin 277 is located within sliding sleeve 275 in its outermost position in direction toward the roll neck portion 221, into which it has been pushed by spring 278. Guided at the inner guideways **275*a* of sliding sleeve 275, the ends 274*b* of the double levers have caused the ends 274*a* of the levers which engage into recesses 273*a* of drive blocks 273 to be brought into the outermost radial position in the radial guideways 272 of support piece 270 and thus have released the installation opening for roll neck portion 21** inserted in the direction of arrow P.

With its movement in direction of arrow P, the end face of roll neck portion 221 touches the opposing end face of the cylindrical pin 277 and presses it counter to the action of spring 278 into the position depicted in FIGS. 11 to 13 within support piece 270. This position is signaled to a control device by cylindrical pin 277, in a manner not depicted here, for example, by means of contactless switching elements. The control device causes the piston-cylinder assembly 282, by means of switching fork 281 which in this case acts upon end face **275*c* of sliding piece 275, to move sliding sleeve 275 in direction of the roll neck portion 221 in such a way that inner clamping guides 275*b* acting upon opposing faces of drive blocks 273 guided in radial guide trough 272, press drive blocks 273 inwards into annular groove 221***a* of roll neck portion 221 and thus cause the coupling of support piece 270 with roll neck portion 221. Once this position of the sliding sleeve is reached, piston-cylinder assembly 282 moves switching fork 281 into the central position depicted in FIGS. 11 to 13, so that during operation it no longer touches the now rotating sliding sleeve 275 at end face 275*c*. The sliding sleeve is retained in the coupling position depicted in FIG. 11 during operation by the closing pressure of spring 280.

While specific embodiments of the invention have been shown and described in detail to illustrate the application of the inventive principles, it will be understood that the invention may be embodied otherwise without departing from such principles.

I claim:

1. A device for axial displacement of a roll in a rolling stand, the roll having an axis and a neck portion, the rolling stand defining a roll housing, comprising a chock mounted axially slidable in the roll housing, axially extending support means attached to said chock, radially inwardly facing guide means formed in said support means, a support piece mounted axially slidable in said guide means, a roll bearing adapted for supporting the roll mounted in said support piece, and a sliding carriage axially slidable in said guide means, said sliding carriage axially spaced from said support piece, a coupling means mounted in said sliding carriage, said coupling means adapted for coupling with the roll neck portion, and at least one hydraulic piston-cylinder assembly connected to said sliding carriage for axially displacing said sliding carriage, a deep-groove-type radial ball bearing mounted in said sliding carriage for receiving said coupling means, wherein said deep-groove-type radial ball bearing receives the roll neck and has a bearing bushing, said coupling means arranged on the side of said bushing facing away from the roll neck portion, said coupling means including another support piece connected to said bushing, said another support piece having coupling means engageable in an annular groove defined in the roll neck portion, and a sliding sleeve axially slidable over said another support piece, said sliding sleeve effecting a radial displacement of said coupling members.

2. A device according to claim 1, comprising another piston-cylinder assembly non-rotatably mounted relative to said sliding carriage, said another piston-cylinder assembly biasing said sliding sleeve against the pressure of a spring.

3. A device according to claim 2, comprising a position-indicating element axially slidably mounted in said support piece, said position-indicating element biased by the pressure of a spring and acted upon by the roll neck portion.

4. A device according to claim 3, wherein said position-indicating element includes a cylindrical pin centrally mounted in said support piece, one end of said cylinder pin facing the end of the roll neck portion.

5. A device according to claims 2 or 3, wherein said coupling members are drive blocks defining central recesses, said drive blocks slidable in radial guide grooves of said support piece, comprising a double lever mounted in said support piece, said double lever having first and second ends, said first ends engaging said central recesses, said second ends resting against inwardly facing guide tracks of said sliding sleeve, and clamping guides defined by said sliding sleeve extending conically narrowing radially inside for engaging said drive blocks.

6. A device according to claims 2 or 3, wherein the side of said sliding sleeve facing away from the neck roll portion is slidingly guided on a central first cylindrical projection of said support piece, and said sliding sleeve has a second cylindrical projection, said second cylindrical projection surrounding said first cylindrical projection, a switching fork connected to said another piston-cylinder assembly slidingly guided on said second cylindrical projection, said switching fork slidable to make contact with annular limiting collars formed on said second cylindrical projection.

* * * * *